United States Patent [19]

Doboze

[11] Patent Number: 4,848,543

[45] Date of Patent: Jul. 18, 1989

[54] DISPOSABLE FOAM PLASTIC PIZZA CONTAINER

[76] Inventor: Christopher K. Doboze, 1003 Washington St., Ogdensburg, N.Y. 13669

[21] Appl. No.: 906,549

[22] Filed: Sep. 12, 1986

[51] Int. Cl.[4] ..... B65D 25/00

[52] U.S. Cl. ..... 206/45.32; 206/545; 206/523; 206/551; 220/339

[58] Field of Search ..... 206/45.32, 545, 523, 206/557, 551; 220/339

[56] References Cited

U.S. PATENT DOCUMENTS

| | | | |
|---|---|---|---|
| 1,526,397 | 2/1925 | Thornton . | |
| 3,335,846 | 8/1967 | Mills . | |
| 3,398,827 | 8/1968 | Laskin . | |
| 3,771,713 | 11/1973 | Davidson . | |
| 3,937,389 | 2/1976 | Wind | 220/339 |
| 3,980,178 | 9/1976 | Schidlowski | 220/339 |
| 4,079,880 | 3/1978 | Edwards | 220/339 |
| 4,127,189 | 11/1978 | Shumray et al. | 220/339 |
| 4,143,805 | 3/1979 | Sutton | 220/339 |
| 4,273,249 | 6/1981 | Florian | 220/339 |
| 4,298,133 | 11/1981 | Davis | 220/339 |
| 4,322,001 | 3/1982 | Hurley | 220/339 |

*Primary Examiner*—Joseph Man-Fu Moy

[57] ABSTRACT

A thermally insulated disposable container for pizzas, pies or other round, flat food items is formed of a unitary sheet of plastic foam material with lower and upper sections each formed with a round flat member and a drafted side wall. An integral, flexible hinge connects a portion of the rim of each of the upper and lower sections, so that the sections can be closed with the pizza or other food item contained inside. Tabs which extend from the side walls of the container carry a Velcro or similar filament pile engaging material to permit the upper and lower sections to be releasably close to one another by the tabs and the engaging materials. In one version, radial ribs in the lower section divide the same into wedge-shaped compartments so that pie wedges of different types of pies can be kept segregated from one another.

13 Claims, 2 Drawing Sheets

DISPOSABLE FOAM PLASTIC PIZZA CONTAINER

BACKGROUND OF THE INVENTION

This invention relates to packages, and is more particularly directed to packages for take out and/or delivery of pizzas, dessert pies, and the like. The invention is more particularly concerned with a thermally insulated disposable container for pizzas or other food items to be served hot (or cold), the container being constructed substantially entirely as a unitary sheet of styrene foam or another food compatible plastic foam material.

The conventional means of packaging pizzas, bakery products, or the like for take out or for home delivery is a cardboard box of square or rectangular shape. These conventional pizza boxes have to be folded up in advance of preparing the pizzas, so that the boxes will be ready when the pizzas are hot. The pizza box blanks usually come in packages of one hundred or two hundred per bundle, and generally an employee will assemble the entire bundle at one time so that the boxes are ready for customers. Therefore, significant space in the pizza restaurant must be dedicated to the assembly of these boxes, and additional space set aside for the storing of the assembled boxes. A standard lot of one hundred assembled pizza boxes form approximately three stacks from floor to ceiling.

The standard carboard pizza box also has a number of drawbacks. For one thing, cardboard containers have a low insulation coefficient, and the cardboard tends to weaken as it moistens. If it is attempted to reheat the pizza in the box in a microwave oven, the cardboard will become soggy. The pizza box will also become soggy if frozen pizzas are thawed while in the box. Also, cardboard harbors bacteria, which can fluorish in it, causing possible health and spoilage problems. In addition, paper dust and cardboard shavings often remain in the cardboard box, and these can mix in with the pizza crust or toppings. Moreover, odors tend to migrate through a cardboard container so that food items stored in the vicinity of a box with uneaten pizza slices will often tend to pick up the flavors and odors of the pizza.

Still further, because the pizza boxes are generally square, whereas the pizzas themselves are generally round, a large amount of space in the box is filled with air rather than with pizza, and thus accelerates the cooling of the pizza between the time of preparation and the time of delivery to a customer. The square box shape also permits shifting of the pizza during delivery, and can permit the pizza crust to flex and bend so that the sauce, cheese or other topping separates from the crust.

Because the moist crust and topping of a pizza can soak the cardboard of the standard container, deli paper or butcher paper is usually required. This is especially so if the pizza is sliced into wedges while in the box, rather than before placing it in the box, as often occurs during restaurant busy hours.

Further still, if wedges of different types of pizza are placed in the same box, or, if pie wedges of different types of dessert pies are placed in the same box, the toppings or fillings tend to run together. Also, because of the shape of standard bakery and pizza boxes, the pizza slices or dessert wedges tend to shift around in the box and contact and damage one another.

OBJECTS AND SUMMARY OF THE INVENTION

It is an object of this invention to provide a container for pizzas or other food items that overcomes the drawbacks of the prior art.

It is a more particular object of this invention to provide a thermally insulated disposable container for pizzas, pies, portions thereof, or other food items to be served hot (or cold) some time after preparation.

It is yet another object of this invention to provide such a thermally insulated disposable container which does not need to be folded up prior to use, and which stacks so as to require only a minimal storage space.

It is yet another object of this invention to provide such a thermally insulated disposable container which is less expensive than conventional containers, both in terms of material cost and in terms of labor cost.

It is still another object of this invention to provide a container which facilitates storage and reheating of any uneaten portions of the pizza, dessert pie, or other similar food item.

In accordance with an aspect of this invention, the thermally insulated disposable container for pizzas or other round flat food items to be served hot is formed substantially entirely as a unitary plastic foam material, such as polystyrene foam. The container has a lower recepacle section and a similarly-shaped upper cover section, which are joined by a hinge that connects a portion of the upper cover section to a corresponding portion of the lower receptacle section, so that the sections can be closed over one another.

The lower receptacle section has a round, flat bottom member and a drafted or tapered side wall surrounding the bottom member and rising slopingly outward to a circular rim. The upper cover section similarly has a round, flat top member and a drafted side wall that depends slopingly outward from the top member to a circular rim that is adapted to fit against the lower receptacle section circular rim.

At least one of the upper and lower sections has a tab formed on it at a position remote from the hinge, and to this tab there is affixed a strip of Velcro, or other equivalent flexible filament pile engaging material, with a cooperating engaging strip of that material being affixed to the other of the receptacle and cover sections so that the sections can be releasably close to one another by this tab and Velcro strip latch arrangement, with the pizza or other food item inside the container.

According to another aspect of this invention, the uppere cover section and the lower receptacle sections can be generally rectangular members, so that the thermally insulated disposable container is adapted for sheet pizzas, Sicilian-style pizzas, or other rectangular flat foot items to be delivered or served hot (or cold).

In yet another aspect of this invention, the thermally insulated disposable container is adapted for pie slices or other wedge-shaped food items to be kept hot or kept cold, and to be kept separate from one another until delivered and served. In this aspect of the invention, the lower receptacle section has a round, generally flat bottom member, but which contains a plurality of radial ribs that rise from the bottom member sufficiently to segregate the pie slices or wedge-shaped food items from each other, and which extend from the center of the bottom member to the circumference thereof, and connect with the drafted side wall of the lower receptacle section. The structure and function of the upper cover section, the flexible hinge, and the tab and Velcro latch members is generally as discussed above for the round pizza container.

The above and many other objects, features and advantages of this invention will be more fully understood from the ensuing detailed description of the preferred embodiments, which should be considered in connection with the accompanying drawing.

DETAILED DESCRIPTION OF THE PREFERRED EMBODIMENT

Figure 1:
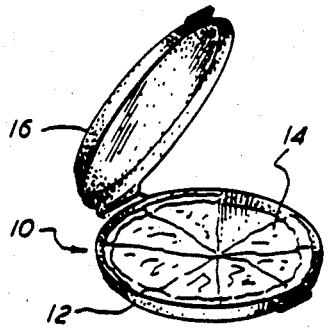
FIG. 1 is a perspective view of a preferred embodiment of the pizza container of this invention, shown with a sliced pizza contained therein, with one wedge of the pizza having been removed.
Figure 2:
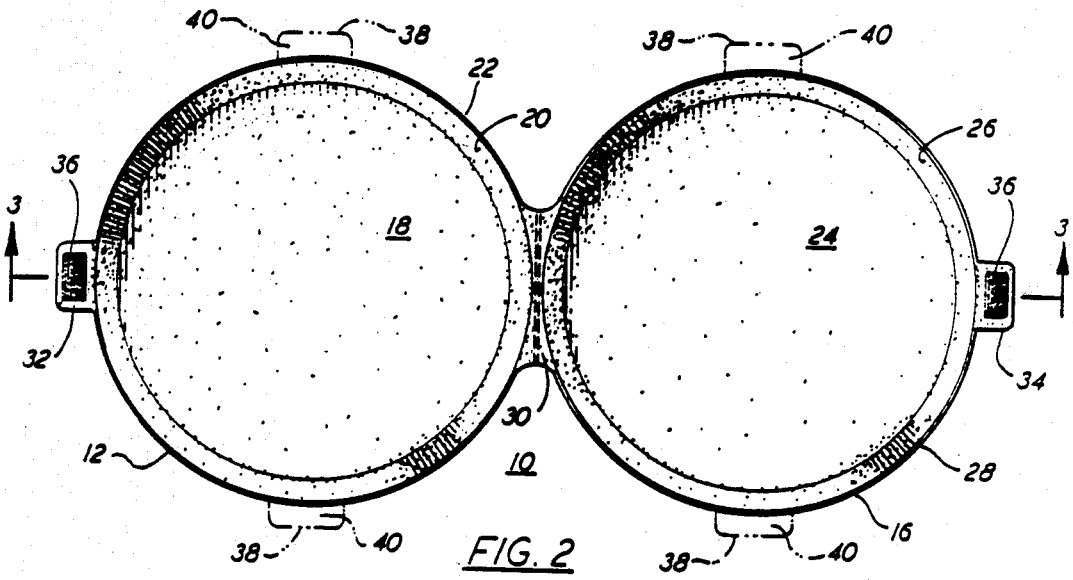
FIG. 2 is a plan view of this pizza container.
Figure 3:
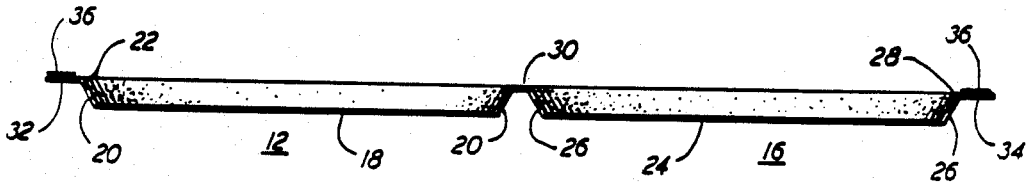
FIG. 3 is a sectional elevation of the container of FIG. 2, taken at the line 3—3 thereof.

With reference to the drawing, and initially to FIGS. 1–3 thereof, a generally round pizza container 10 is here formed as a unitary sheet of polystyrene foam, although other food-compatible plastic foam material could be used instead.

As shown in FIG. 1, the container has a generally round receptacle section 12, here shown containing a round pizza 14, that is cut into eight wedges, with one wedge having been removed. A round cover section 16, of a shape similar or identical to that of the receptacle section 12, closes over the pizza 14 to contain it.

As shown in FIGS. 2 and 3, the receptacle section 12 has a generally round, flat base or bottom 18 and a conic side wall 20 that is flared or drafted so as to angle outward at about twenty-five degrees from the vertical. The side wall 20 rises from the circumference of the base 18 to a generally circular edge or lip 22. Here "round" can mean octagonal, etc., as well as circular.

The round cover section 16 has a generally round, flat top 24 of about the same size as the bottom 18, and a conic side wall 26 which is flared or drafted and depends from the circumference of the top 24 outward about twenty-five degrees from the vertical to a generally circular edge or lip 28 that is adapted to mate with the edge or lip 22 of the lower section 12 when the container 10 is closed. A hinge 30 extends along a portion of the periphery of the circular edges 22 and 28, and hingedly joins the receptacle section 12 to the cover section 16.

The receptacle section 12 and cover section 16 have substantially the same depth.

A pair of tabs 32 and 34 are formed opposite one another on the respective side walls 20 and 26 of the sections 12 and 16, at portions thereof diametrically opposite the hinge 30. Strips of Velcro or a similar filament-type closure material are affixed onto mating surfaces of the tabs 32 and 34 so that when the pizza container 10 is closed along the hinge line of the hinge 30, the strips 36 of the tabs 32 and 34 will engage one another, as shown in FIG. 4, to hold the receptacle section 12 and the cover section 16 in releasable engagement with one another.

Optionally, as shown in ghost lines in FIG. 2, additional tabs 38 can be positioned at the sides of the container sections 12 and 16, and these would each carry separate pieces of Velcro or an equivalent filament pile engaging closure material.

It should be noted that the filament pile-type engaging material employed in the strips 36 and 40 can be of complementary types, wherein one strip is formed of hook material while the other is formed of loop material. Alternatively, the strips can be formed of the same type, such as a ball-end filament material in which upstanding ball-ended filaments engage the balls or spheres of the opposing ball-ended filaments. In addition, rather than employing separate strips which can be affixed to the tabs 32, 34, and 38, the strips 36 and 40 can be formed of polystyrene unitarily with the foam sheet of the container 10.

Figure 4:
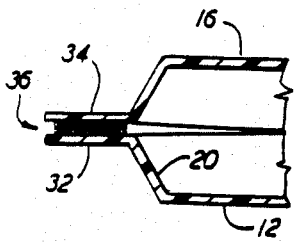
FIG. 4 is a detail sectional view of the above embodiment, showing the closure arrangement.
Figure 5:
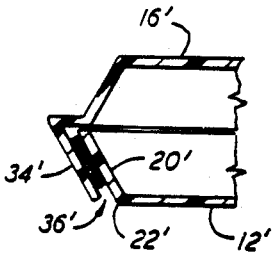
FIG. 5 is a sectional view, similar to FIG. 4, showing an alternative closure arrangement.

An alternative version of the closure portion of this pizza container is shown in FIG. 5, wherein the elements shown in FIG. 4 are identified with the same reference numbers, but primed. Here, a tab 34' is formed only on the upper or cover section 16' and the Velcro strip 36' that mates with the Velcro strip 36' of the tab 34' is carried on the outer surface of lower section side wall 20'.

The disposable foam plastic pizza containers 10 of this embodiment are dimensioned to have diameters suitable to accommodate standard size pizzas, that is, about nine inches, twelve inches, fourteen inches, or sixteen inches, and the side walls 20 and 26 define an interior height for the closed container 10 of about one inch. The containers are rather light in weight, being about one-half ounce each, so that a sleeve of one hundred containers has a total weight of only about three pounds. The foam plastic material has sufficient strength and rigidity so that there is only a minimal distortion when pizzas are carried in them. As the cover and receptacle portions are the same size and shape, the pizza or other food item can be placed in either one and covered with the other.

Unlike the cardboard pizza boxes presently used, no assembly is required in the pizza shop or restaurant, nor is deli sheet or butcher paper required. Because the pizza container 10 is round, there is no wasted space, and the pizza does not shift within the container. These pizza containers stack or nest with one another, so that a sleeve of one hundred to two hundred containers 10 occupies only a minimal amount of storage space. The polystyrene foam containers are far superior in heat retention than cardboard, yet are far less expensive than the cardboard containers.

In addition, the polystyrene foam containers 10 are far more practical than is the conventional cardboard container for reheating pizza slices in a microwave oven or for freezing and storing uneated pieces in the container. The plastic foam sheet is far more resistant than cardboard to the infection with bacteria or the growth of bacteria, is not subject to contamination by shavings or paper dust, and is far superior in its ability to contain food odors which would migrate through a cardboard container. The containers of this invention will sustain both moisture and slicing of the pizzas without weakening of the bottom member 18 due to food moisture.

Furthermore, if the pizza restaurant is selling pizza by the slice, the pizzas can remain hot much longer if kept in the styrene foam container 10, so that it is often unnecessary to reheat a slice for a customer.

Figure 8:
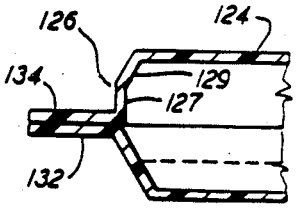
FIG. 8 is a detail sectional of the embodiment of FIGS. 6 and 7.
Figure 6:
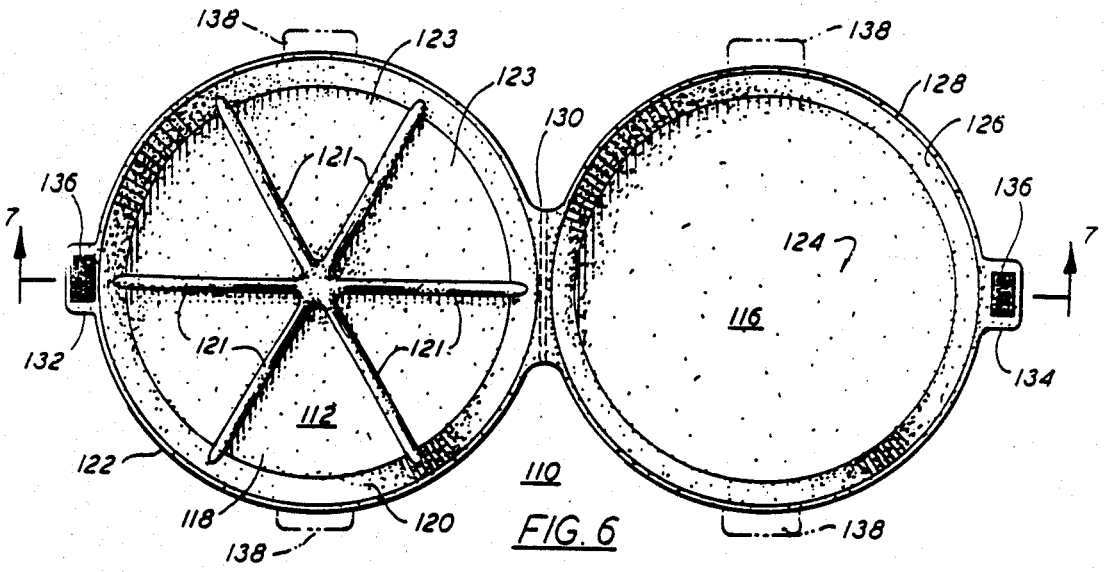
FIG. 6 is a plan view of a second embodiment of this invention, which is a container for several individually cut wedges or pie slices.
Figure 7:
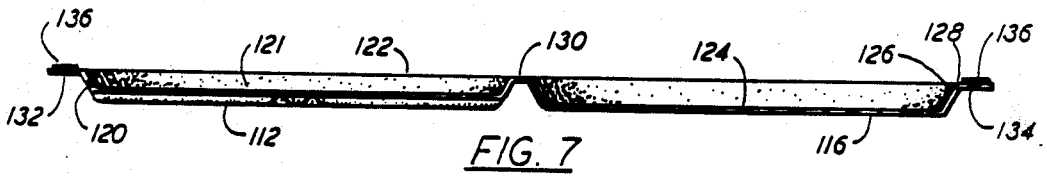
FIG. 7 is a sectional elevation of the second embodiment, taken at the line 7—7 of FIG. 6.

Another embodiment of this invention is shown in FIGS. 6 and 7, and in that embodiment, elements that are shared with the first embodiment are identified with the same reference characters, but raised by 100. In this embodiment, a dessert pie slice container 110 has ribs 121 formed in the bottom member 118 of the receptacle section 12, and these ribs 121 radiate from a center of the bottom member 118 to the circumference thereof where they join the side wall 120. These ribs extend upwards part way to the edge or rim 122, and define wedge-shaped compartments 123. The upper cover section 116 is of generally similar size and shape to the lower receptacle section 112, and is joined thereto by a unitarily formed hinge 130. This upper cover section 116 can have a knee-shaped side wall 126 with a steep portion 127 and a more sharply sloped portion 129, as shown in FIG. 8. As with the first embodiment, tabs 132 and 134 carrying Velcro strips 136 or other filament pile engaging material, hold the upper and lower sections 116 and 112 in releasable engagement with each other.

This container 110 can be used when a customer desires to purchase several individual pieces of different types of pies, and the dividing ribs 121 will keep the juices and fillings from the various pie pieces in the respective compartments 123 from mixing with one another. Where the container 110 is intended for use with dessert pies, the internal diameter and internal height should be about the same as that of a standard dessert pie, namely a diameter of about eight to twelve inches and a height in the range of about one to two inches. In that case, as shown, the ribs 121 should have equal angular spacing so that the compartments 123 are of about the same size. While a six-compartment version is shown here, a four compartment and an eight compartment container for pies, cakes, and pastries would be constructed on the same principles.

Figure 9:
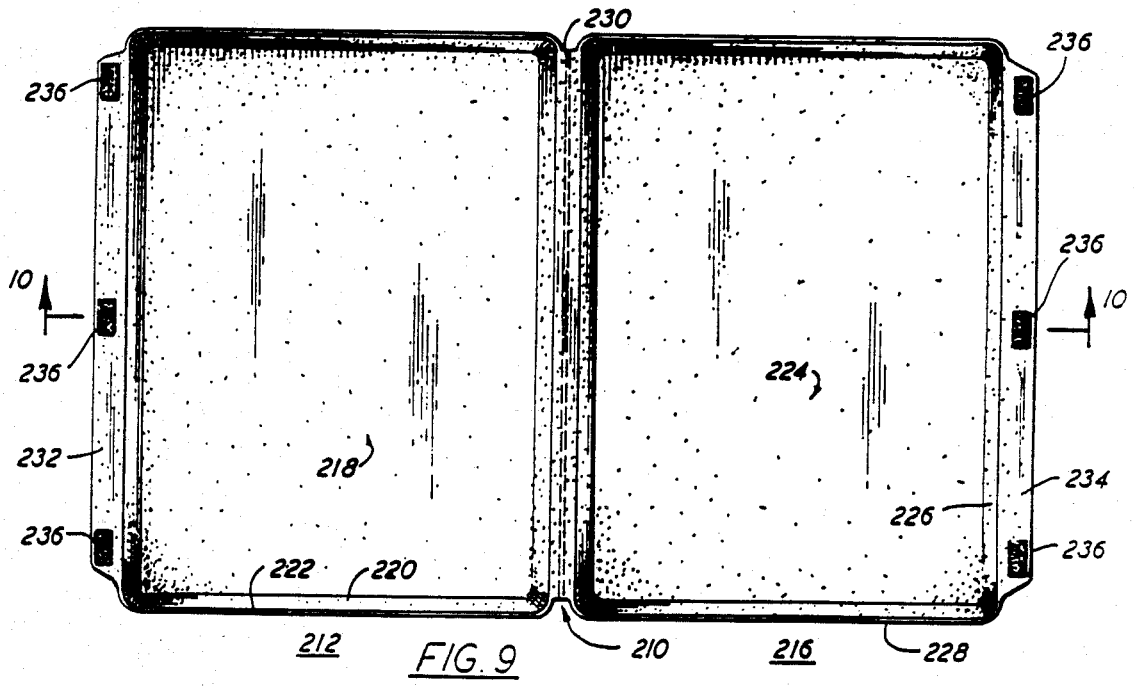
FIG. 9 is a plan view of a third embodiment, here a disposable container for a generally rectangular sheet pizza.
Figure 10:
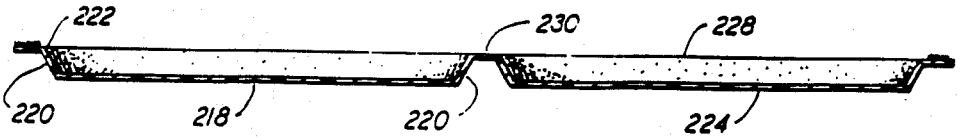
FIG. 10 is a sectional elevation of the third embodiment, taken at the line 10—10 of FIG. 9.

The basic structure of this invention can be applied to a container for sheet pizzas or the like, as in the embodiment shown in FIGS. 9 and 10. Here, the elements that correspond to elements in the FIG. 1 embodiment are identified with the same reference numbers, but raised by 200. In this embodiment, the container 210 is formed as a unitary sheet of foam polystyrene, nominally one-quarter inch thick, and has dimensions to accommodate a sheet pizza of about twelve by eighteen inches or about twenty-four by eighteen inches. The container 210 has a base 212 and a cover 216 which are both of a generally rectangular shape, the base 212 having a generally rectangular bottom panel 218, and a side wall 220 that is flared or drafted outward to a generally rectangular rim 222. The cover 216 has a similar flat panel 224 and similar flared or drafted side wall 226 that extends to a generally rectangular rim 228. A hinge unitarily formed with the base 212 and cover 216 joins the same along one edge of each of the rims 222 and 228. As with the first embodiment, tabs 232 and 234 are formed on the edges of the base 212 and cover 216 opposite the hinge 230 and each of these carries mating strips 236 of a suitable filament pile engaging material.

The side walls 220 and 226 together define an internal height for the sheet pizza container 210 of about one inch to two inches so as to accomodate a standard sheet pizza.

A similar design (not shown) can be employed for a sandwich container, especially for a sandwich of the "sub" or "hoagie" type, which is made on a long roll of about 2½ to 3 inches by about 8 to 12 inches. Here the sub or hoagie container is a casket-shaped polystyrene foam box with generally rectangular base and cover portions that have a unitary hinge formed along adjacent long walls, and a pair of mating tabs on opposite mating long walls, with Velcro material or the like affixed on the tabs. This type of container prevents juices from the sandwich from leaking out, facilitates reheating in the case of a hot sub or hoagie, and keeps the sandwich fresh until delivered to the customer.

While this invention has been described in detail with respect to several preferred embodiments, it should be understood that the invention is not limited to those embodiments, and that many modifications and variations would present themselves to those of skill in the art without departing from the scope and spirit of this invention, as defined in the appended claims.

What is claimed is:

1. A thermally insulated disposable container for pizzas or other round flat food items to be served hot, the container being constructed substantially entirely as a unitary sheet of plastic foam material, said container comprising:

a lower receptacle section including a round, flat bottom member and a drafted side wall surrounding said bottom member and rising slopingly outward to a circular rim;

an upper cover section including a round, flat bottom member and a drafted side wall surrounding said bottom member and rising slopingly outward to a circular rim;

wherein said receptacle section and said cover section are of generally identical dimensions and of geometrically similar shape so the pizza or other food item can be placed into either said section and covered with the other said section;

an integral flexible hinge connecting a portion of the rim of the upper cover section to the rim of the lower receptacle section, so that these sections can be closed rim to rim with the pizza or other food item contained within the container;

at least one tab extending from the circular rim of the side wall of each one of said receptacle and cover sections at a position remote from said hinge, each of said tabs having a circumferential extent smaller than the circumference of the receptacle section and the cover section, said tabs being located at complimentary positions to one another; and latch means formed of a flexible filament pile engaging material, one portion of which is affixed to one of said tabs and an engaging portion of which is affixed to the other of said tabs on the receptacle and cover sections to permit the sections to be releasably closed to one another by said latch means.

2. The thermally insulated container of claim 1 wherein foam material is a polystyrene foam.

3. The thermally insulated container of claim 1 wherein said bottom is the diameter of a standard round pizza in the range of nine to sixteen inches, and said side walls of the receptacle and cover sections are of substantially the same height and are dimensioned so as to define an internal height for the closed container of substantially one inch.

4. The thermally insulated container of claim 1, further comprising additional tabs disposed on said container section rims between the hinge and the first mentioned and said corresponding tabs such that the additional tabs of one said section mate with the additional tabs of the other, with said latch means further including additional flexible thread pile engaging material on mating faces of said additional tabs.

5. A thermally insulated disposable container for sheet pizzas or other rectangular flat food items to be delivered and served hot, the container being constructed substantially entirely as a unitary sheet of plastic foam material, said container comprising:

a lower receptacle section including a rectangular, flat bottom member and a drafted side wall surrounding said bottom member and rising slopingly outward to a generally rectangular rim;

an upper cover section including a rectangular, flat top member and a drafted side wall depending slopingly outward from said top to a generally rectangular rim adapted to fit against the rim of the lower receptacle section;

wherein said receptacle section and said cover section are of substantially identical dimensions and of geometrically similar shape so the sheet pizza or other flat food item can be placed into either said section and covered with the other said section;

an integral flexible hinge joining an edge of the upper cover section rim to a corresponding edge of the lower receptacle section rim so that these sections can be closed rim to rim with the sheet pizza or other food item contained therein;

at least one tab extending from the rim of each one of said receptacle and cover sections opposite said hinge, each of said tabs having a circumferential extent smaller than the circumference of the receptacle section and the cover section; and latch means formed of a flexible filament pile engaging material, one portion of which is affixed to one of said tabs and an engaging portion of which is affixed to the other of said tabs on the receptacle and cover section to permit the sections to be releasably closed to one another by said latch means.

6. The thermally insulated container of claim 5 wherein said foam plastic material is a polystyrene foam.

7. The thermally insulated container of claim 5 wherein said bottom is substantially the size of a standard sheet pizza in the range of eighteen by twelve inches to eighteen by twenty-four inches, and said side walls are dimensioned to define an internal height for the closed container of substantially one inch to two inches.

8. A thermally insulated disposable container for pie slices or other wedge-shaped food items to be kept hot or kept cold until delivered and served, the container being constructed substantially entirely as a unitary sheet of plastic foam material, said container comprising;

a lower receptacle section including a round, generally flat bottom member having a cener and a circumference, a plurality of radial ribs therein rising from said bottom sufficiently to segregate said pie slices or wedge-shaped food items from each other, and extending from the center to the circumference of the bottom member, thus dividing the bottom member into a plurality of wedge-shaped compartments, and a drafted side wall surrounding said bottom member and rising slopingly outward to a circular rim;

an upper cover section including a round, generally flat top member and a drafted side wall sloping outward to a circular rim adapted to fit against the lower receptacle section circular rim;

an integral flexible hinge connecting a portion of the rim of the upper cover section to the rim of the lower receptacle section, so that these sections can be closed rim to rim with said pie slices or other wedge shaped food items contained therein;

at least one tab extending from the circular rim of the side wall of each one of said receptacle and cover sections at a position remote from said hinge, each of said tabs having a circumferential extent significantly smaller than the circumference of the receptacle section and the cover section; and latch means formed of a flexible thread pile engaging material, one portion of which is affixed to a surface of one of said tabs and an engaging portion of which is affixed to the other of said tabs on the receptacle and cover sections to permit these sections to be releasably closed to one another by said latch means.

9. The thermally insulated disposable container of claim 8 wherein said ribs meet one another at said center and are connected to said lower receptacle section side wall.

10. The thermally insulated disposable container of claim 8 wherein said ribs of the lower receptacle section are spaced such that the compartments are all of substantially equal size.

11. The thermally insulated disposable container of claim 8 wherein said top, bottom, and side walls are dimensioned to define an internal diameter and an internal height that correspond to a standard dessert pie, the diameter being in the range of eight to twelve inches and the height being in the range of about one to two inches.

12. A thermally insulated disposable container for food items, the container being constructed substantially entirely as a unitary sheet of plastic foam material, said container comprising a lower receptacle section including a flat bottom member and a drafted side wall surrounding said bottom member and rising slopingly outward to a circular rim;

an upper cover section including a round flat top member, similar in shape to the lower section flat bottom member, and a drafted side wall sloping outward to a rim adapted to mate against the rim of the lower receptacle section;

wherein said receptacle section and said cover section are of substantially identical dimensions and of geometrically similar shape so that the pizza or other food item can be placed into either said section and covered with the other said section;

an integral flexible hinge connecting a portion of the rim of the upper section to a corresponding portion of the rim of the lower receptacle section so that these sections can be closed rim to rim with the food item within the container;

at least one tab extending from the circular rim of the sidewall of each one of said receptacle and cover sections at a position remote from said hinge, each of said tabs having a circumferential extent smaller than the circumference of the receptacle section and the cover section; and latch means formed of a flexible filament pile engaging material, one portion of which is affixed to one of said tabs and an engaging portion of which is affixed to the other of said receptacle and cover sections to permit the sections to be releasably closed to one another by said latch means.

13. The thermally insulated container of claim 8, wherein said receptacle section and said cover section have their respective round flat top and bottom members and drafted side walls of substantially the same dimensions, so that said food items can be placed into either said section and covered with the other said section.

* * * * *